US008982006B2

(12) United States Patent
Wang et al.

(10) Patent No.: US 8,982,006 B2
(45) Date of Patent: Mar. 17, 2015

(54) DIPOLE ANTENNA AND RADIO-FREQUENCY DEVICE

(71) Applicant: Wistron NeWeb Corporation, Hsinchu (TW)

(72) Inventors: Chih-Ming Wang, Hsinchu (TW); Kuan-Chung Chen, Hsinchu (TW); Yu-Yu Chiang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 162 days.

(21) Appl. No.: 13/748,613

(22) Filed: Jan. 24, 2013

(65) Prior Publication Data

US 2014/0132469 A1 May 15, 2014

(30) Foreign Application Priority Data

Nov. 9, 2012 (TW) ..... 101141711 A

(51) Int. Cl.

| | |
|---|---|
| ***H01Q 9/16*** | (2006.01) |
| ***H01Q 1/22*** | (2006.01) |
| ***H01Q 5/00*** | (2006.01) |
| ***H01Q 9/28*** | (2006.01) |

(52) U.S. Cl.

CPC ..... *H01Q 1/2266* (2013.01); *H01Q 5/0055* (2013.01); *H01Q 5/0058* (2013.01); *H01Q 9/285* (2013.01)

USPC ..... 343/821; 343/795

(58) Field of Classification Search

USPC ..... 343/793, 795, 821

See application file for complete search history.

(56) References Cited

U.S. PATENT DOCUMENTS

| | | | | |
|---|---|---|---|---|
| 6,961,028 | B2 * | 11/2005 | Joy et al. | 343/895 |
| 7,501,987 | B2 * | 3/2009 | Wang et al. | 343/702 |
| 7,724,201 | B2 * | 5/2010 | Nysen et al. | 343/821 |
| 8,723,750 | B2 * | 5/2014 | Podduturi | 343/795 |

* cited by examiner

*Primary Examiner* — Tan Ho

(74) *Attorney, Agent, or Firm* — Winston Hsu; Scott Margo

(57) ABSTRACT

A dipole antenna is disclosed. The dipole antenna includes a feed-in terminal, a balun, a first radiator and a second radiator. The feed-in terminal is used for feeding in a radio-frequency signal. The balun is electrically connected to the feed-in terminal for driving out a return current of the dipole antenna to balance a feed-in impedance of the dipole antenna. The first radiator is electrically connected to the feed-in terminal and the balun for radiating the radio-frequency signal in a first frequency band. The second radiator is electrically connected to the first radiator, the feed-in terminal and the balun for radiating the radio-frequency signal in a second frequency band.

14 Claims, 7 Drawing Sheets

DIPOLE ANTENNA AND RADIO-FREQUENCY DEVICE

BACKGROUND OF THE INVENTION

1. Field of the Invention

The present invention relates to a dipole antenna and radio-frequency device, and more particularly, to a dipole antenna and radio-frequency device having a balun to balance a feed-in impedance.

2. Description of the Prior Art

An antenna is used for transmitting or receiving radio waves, to communicate or exchange wireless signals. An electronic product with a wireless communication function, such as a tablet computer, a laptop or a personal digital assistant (PDA), usually accesses a wireless network through a built-in antenna.

Please refer to FIG. 1, which is a schematic diagram of an RF (Radio-Frequency) device 10. The RF device 10 has a function of wireless communication; take a note book computer for example. The RF device 10 includes an antenna 11, an RF signal process unit 12 and a housing 13. In general, to prevent the antenna 11 from being disposed within a metallic environment, such as a central area disposed with metal parts, a hard disk, input-output ports or a mother board (not shown in FIG. 1), the antenna 11 is normally disposed on a border of the housing 13. Thus, it is usual to use a metal wire, e.g. a co-axial cable 14, to transmit an RF signal received and radiated by the antenna 11 to the RF signal process unit 12 for further signal process.

However, the above mentioned design principle may cause the co-axial cable 14 for transmitting the RF signal to become a part of a radiator of the antenna 11. If the co-axial cable 14 is interfered by noises, the RF signal will be interfered by noises as well, and a signal quality of the RF signal may be decreased accordingly.

On the other hand, the co-axial cable 14 may have different levels of influence on antenna performances according to different antenna types. For example, a gain of a dipole antenna is theoretically higher than a gain of a monopole antenna and also higher than a gain of a PIFA (Planar Inverted-F Antenna), but the co-axial cable 14 may unbalance a feed-in impedance of the dipole antenna. As a result, the antenna performance of the dipole antenna may be changed once the co-axial cable 14 is changed, e.g. impedance changes by cable routes, which may decrease stability and reliability of the dipole antenna 11 during manufacture.

Therefore, how to design the dipole antenna having a stable performance and a balanced feed-in impedance to improve the stability and the reliability during manufacture has become a topic in the industry.

SUMMARY OF THE INVENTION

It is therefore an object of the present invention to provide a dipole antenna and radio-frequency device to improve an antenna performance and balance a feed-in impedance.

The present invention discloses a dipole antenna, comprising a feed-in terminal for feeding in an radio-frequency signal, a balun electrically connected to the feed-in terminal for driving out a return current of the dipole antenna to balance a feed-in impedance of the dipole antenna, a first radiator electrically connected to the feed-in terminal and the balun for radiating the radio-frequency signal in a first frequency band, the first radiator comprising a first arm having one end electrically connected to the feed-in terminal and the balun, the first arm having another end opened, and a second arm having one end electrically connected to the balun, the second arm having another end opened, and a second radiator electrically connected to the first radiator, the feed-in terminal and the balun for radiating the radio-frequency signal in a second frequency band, the second radiator comprising a third arm having one end electrically connected to the feed-in terminal, the first arm and the balun, the third arm having another end opened, and a fourth arm electrically connected to the balun and the second arm, the fourth arm having another end opened.

The present invention further discloses a radio-frequency device, comprising a radio-frequency signal process unit for generating a radio-frequency signal, and a dipole antenna comprising a feed-in terminal for feeding in the radio-frequency signal, a balun electrically connected to the feed-in terminal for driving out a return current of the dipole antenna to balance a feed-in impedance of the dipole antenna, a first radiator electrically connected to the feed-in terminal and the balun for radiating the radio-frequency signal in a first frequency band, the first radiator comprising a first arm having one end electrically connected to the feed-in terminal and the balun, the first arm having another end opened, and a second arm having one end electrically connected to the balun, the second arm having another end opened, and a second radiator electrically connected to the first radiator, the feed-in terminal and the balun for radiating the radio-frequency signal in a second frequency band, the second radiator comprising a third arm having one end electrically connected to the feed-in terminal, the first arm and the balun, the third arm having another end opened, and a fourth arm electrically connected to the balun and the second arm, the fourth arm having another end opened.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
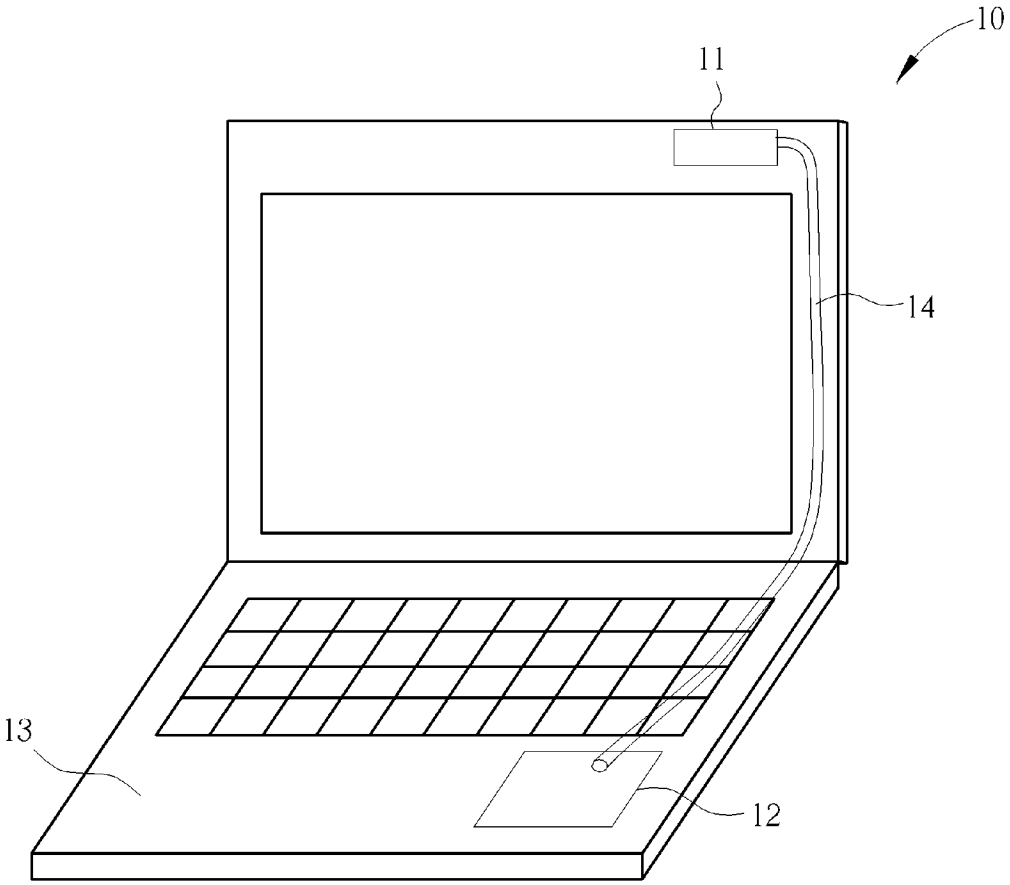
FIG. 1 PRIOR ART
FIG. 1 is a schematic diagram of a radio-frequency device.
Figure 2:
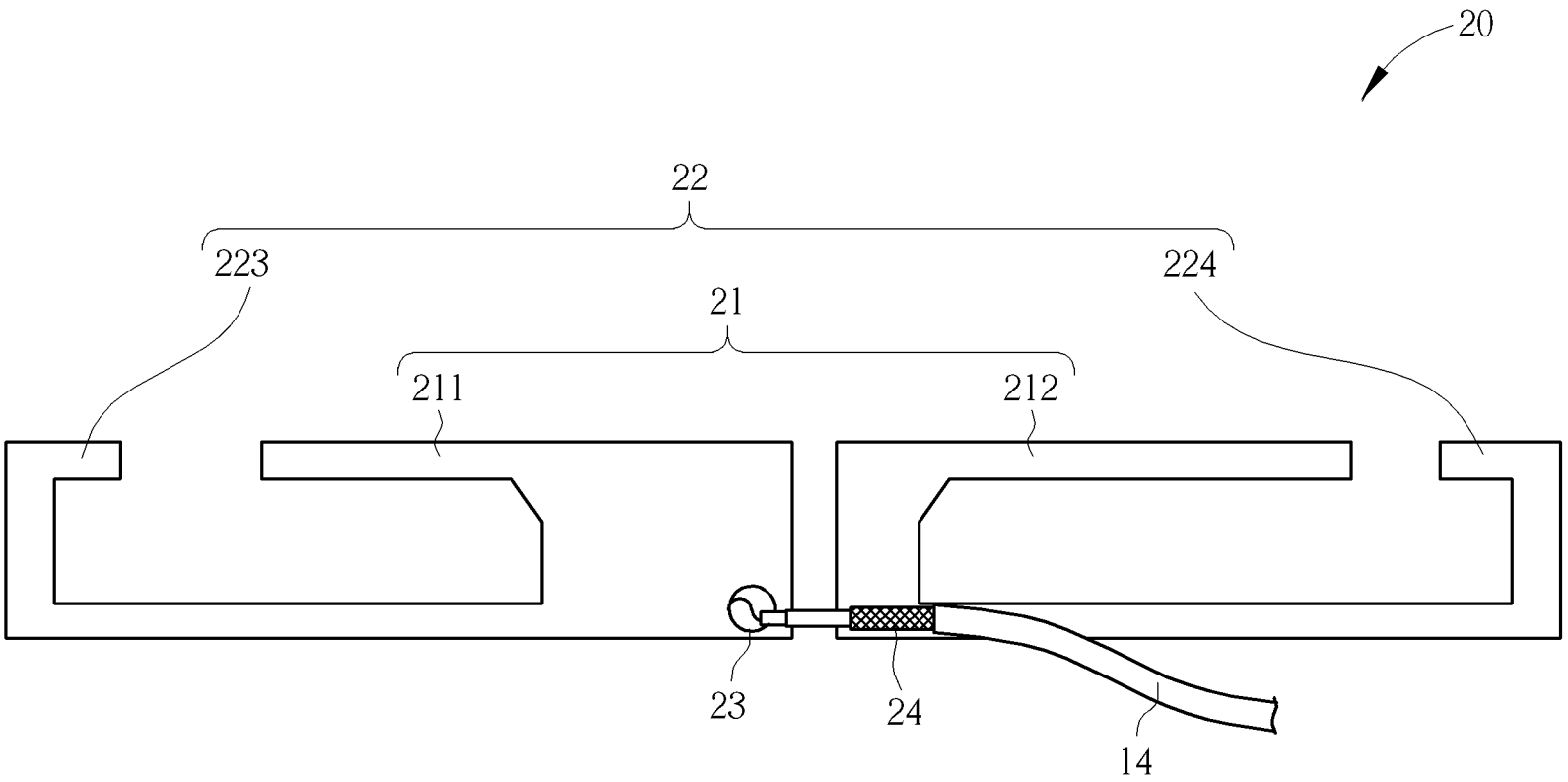
FIG. 2 is a schematic diagram of a dipole antenna.

Please refer to FIG. 2, which is a schematic diagram of a dipole antenna 20. The dipole antenna 20 maybe substituted for the antenna 11 shown in FIG. 1, and used for transmitting and receiving an RF (Radio-Frequency) signal, and the RF signal may be transmitted to the RF signal process unit 12 (not shown in FIG. 2) by the co-axial cable 14. The dipole antenna 20 includes a feed-in terminal 23, a first radiator 21 and a second radiator 22. The feed-in terminal 23 is used for feeding in the RF signal. The first radiator 21 is electrically connected to the feed-in terminal 23 for radiating the RF signal in a high frequency band. The second radiator 22 is electrically connected to the first radiator 21 and the feed-in terminal 23 for radiating the RF signal in a low frequency band.

In detail, the first radiator 21 includes a first arm 211 and a second arm 212, wherein the first arm 211 is electrically connected to the feed-in terminal 23, the second arm 212 is electrically connected to the woven shield 24 of the co-axial cable 14. In such a structure, the first radiator 21 maybe regarded as a dipole antenna whose RF current (i.e. the RF signal) may flow on the first arm 211 and a return current may flow from the second arm 212 and following the woven shield 24 of the co-axial cable 14 to the RF signal process unit 12. Similarly, the second radiator 22 includes a third arm 223 and a fourth arm 224, wherein the third arm 223 is electrically connected to the feed-in terminal 23, the fourth arm 224 is electrically connected to the woven shield 24 of the co-axial cable 14. Hence, the second radiator 22 maybe regarded as a dipole antenna as well, whose RF current (i.e. the RF signal) may flow on the third arm 223, and a return current may flow from the fourth arm 224 and following the woven shield 24 of the co-axial cable 14 to the RF signal process unit 12. Lengths of current routes of the first arm 211 and the second arm 212 are different from lengths of current routes of the third arm 223 and the fourth arm 224, which may induce different resonate modes such that the dipole antenna 20 may operate indifferent frequency bands simultaneously.

In short, the dipole antenna 20 electrically connects the first radiator 21 with the second radiator 22, which may viewed as combining two dipole antennas into one antenna to reach dual operating bands .

However, since the return current of the dipole antenna 20 directly flows to the woven shield 24 of the co-axial cable 14, a matching impedance or a feed-in impedance between the co-axial cable 14 and the dipole antenna 20 may be changed due to an impedance change of the co-axial cable 14 caused by a cable routing change. As a result, the antenna performance of the dipole antenna 20 may be unstable during manufacture.

Figure 3:
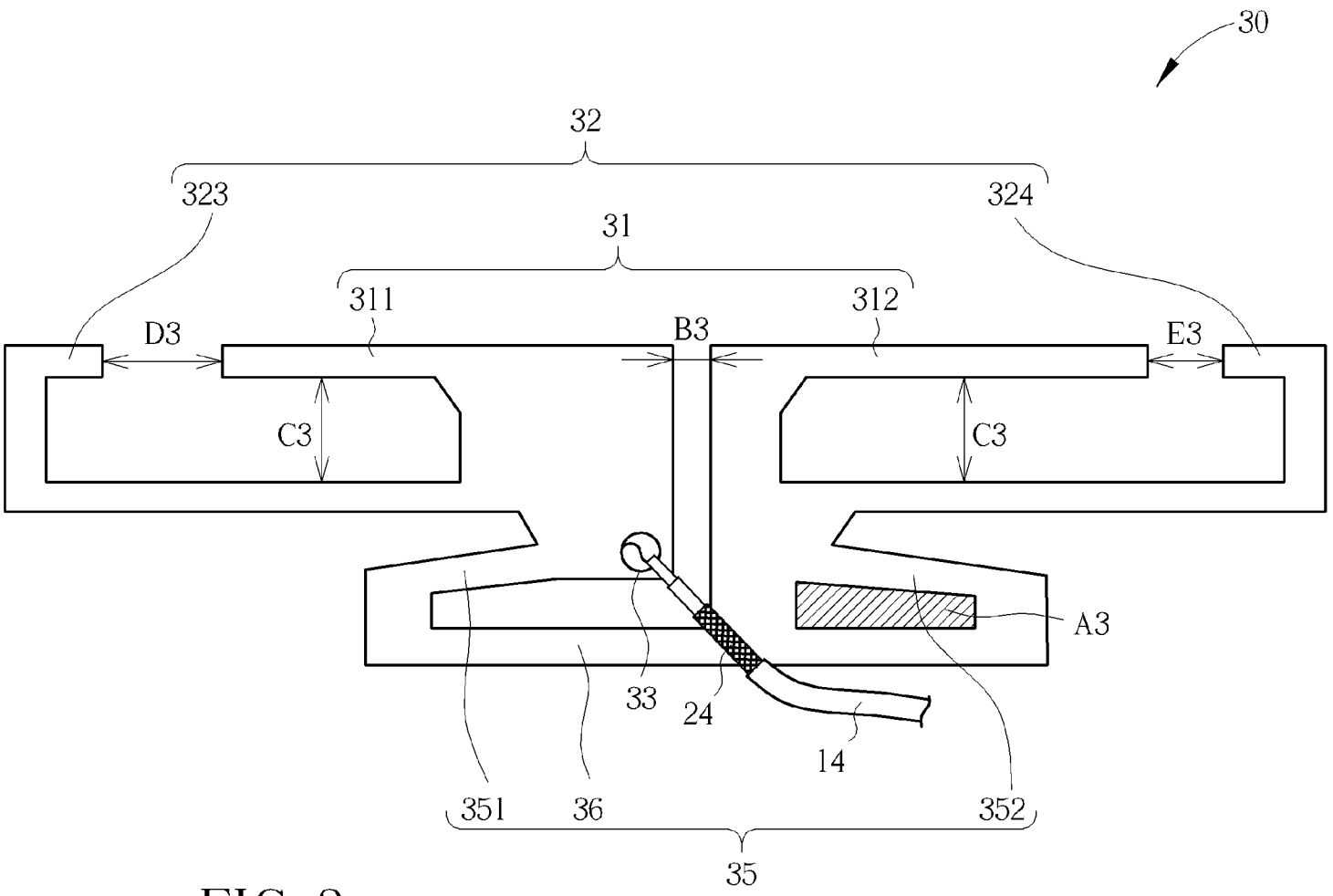
FIG. 3 is a schematic diagram of a dipole antenna according to an embodiment of the present invention.

Therefore, to improve the stability of the dipole antenna 20 during manufacture, please refer to FIG. 3, which is a schematic diagram of a dipole antenna 30 according to an embodiment of the present invention. The dipole antenna 30 may take the place of the dipole antenna 20 shown in FIG. 2 to realize the antenna 11 shown in FIG. 1. The dipole antenna 30 includes a feed-in terminal 33, a balun 35, a first radiator 31 and a second radiator 32. The balun 35 is electrically connected to the feed-in terminal 33 for driving out a return current of the dipole antenna 30 to balance a feed-in impedance of the dipole antenna 30. The first radiator 31 and the second radiator 32 are electrically connected to the feed-in terminal 33 and the balun 35, and are respectively used for radiating the RF signal in high and low frequency bands. The first radiator 31 includes a first arm 311 and a second arm 312, wherein the first arm 311 has one end electrically connected to the feed-in terminal 33 and balun 35, and the first arm 311 has another end opened. The second arm 312 has one end electrically connected to balun 35, and the second arm 312 has another end opened. The second radiator 32 includes a third arm 323 and a fourth arm 324. The third arm 323 has one end electrically connected to the feed-in terminal 33, the first arm 311 and the balun 35, and the third arm 323 has another end opened. The fourth arm 324 has one end electrically connected to the second arm 312 and the balun 35, and the fourth arm 324 has another end opened.

The balun 35 includes a first grounded arm 351, a second grounded arm 352 and a ground unit 36. The ground unit 36 is used for providing grounding. The first grounded arm 351 has one end electrically connected to the first arm 311, the third arm 323 and the feed-in terminal 33, and the first grounded arm 351 has another end electrically connected to the ground unit 36. The second grounded arm 352 has one end electrically connected to second arm 312 and fourth arm 324, and the second grounded arm 352 has another end electrically connected to ground unit 36. In such a structure, the return current may flow from the first grounded arm 351, the second grounded arm 352 and return to the ground unit 36 when the RF signal is fed in the dipole antenna 30, which may reduce an amount of the return current flowing on the woven shield 24 of the co-axial cable 14, and prevent the noise carried by the return current from flowing into the RF signal process unit 12 through the woven shield 24.

Simply speaking, compared with the dipole antenna 20, the dipole antenna 30 further includes the balun 35 to convert the feed-in impedance of the antenna 30 from unbalanced into balanced, which may reduce an electromagnetic interference effect caused by the return current and improve the stability of the dipole antenna 30.

Figure 4:
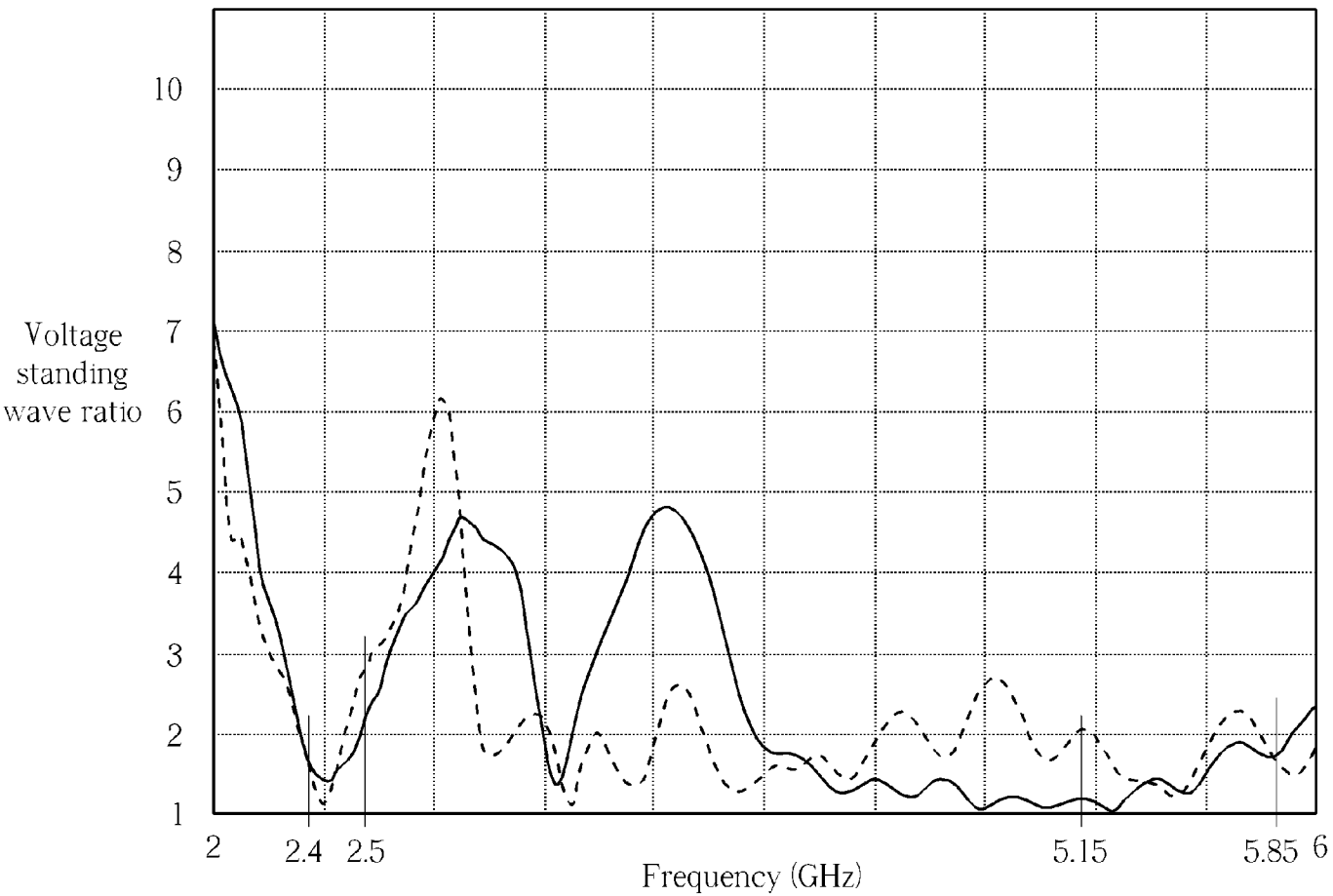
FIG. 4 is a schematic diagram illustrating a voltage standing wave ratio of the dipole antenna shown in FIG. 2 compared with a voltage standing wave ratio of the dipole antenna shown in FIG. 3.

Please refer to FIG. 4, which is a schematic diagram illustrating a VSWR (Voltage Standing Wave Ratio) of the dipole antenna 20 compared with a VSWR of the dipole antenna 30. The VSWR of the dipole antenna 20 is denoted with a dashed line, the VSWR of the dipole antenna 30 is denoted with a solid line. As shown in FIG. 4, within a low operating frequency band 2.4-2.5 GHz and a high frequency band 5.15-5.85 GHz for a WLAN (Wireless Local Area Network), the VSWR of the dipole antenna 30 is less than two, the VSWR of the dipole antenna 20 is partially greater than two.

As can be seen from FIG. 4, the dipole antenna 30 having the balun 35 may reach a better antenna performance than the dipole antenna 20. Besides, the balun 35 may convert the feed-in impedance of the dipole antenna 30 from unbalanced due to the co-axial cable 14 into balanced, which may reach a better stability and an immunity against the noise.

Please note that the dipole antenna 30 of the present invention is to utilize the balun 35 to balance the feed-in impedance to improve the antenna performance and stability of the dipole antenna 30. Those skilled in the art may make modifications or alterations accordingly. For example, a shape of the balun 35 is changeable and a structure of connecting the balun 35 with the first radiator 31 and the second radiator 32 is adjustable to adjust the matching impedance of the dipole antenna 30. Lengths of arms and shapes of the first radiator 31 and second radiator 32 are adjustable, and a relative location between the first radiator 31 and second radiator 32 is also adjustable to adjust the match impedance of the dipole antenna 30 according to practical requirements.

As shown in FIG. 3, the second grounded arm 352 of the balun 35 and the ground unit 36 may form a closed loop area A3, an area of the closed loop area A3 may be adjustable to adjust the matching impedance of the dipole antenna 30. There is a gap B3 between the first arm 311 and the second arm 312 of the first radiator 31. The gap B3 may induce a coupling effect to adjust the match impedance of the dipole antenna 30. There is a gap C3 between the first arm 311 of the first radiator 31 and the third arm 323 of the second radiator 32. The gap C3 may adjustable to adjust the match impedance of the dipole antenna 3. The first arm 311 and the second arm 312 of the first radiator 31 respectively have a bend such that the ends opened of the first arm 311 and the second arm 312 may lie on a same extended line. Or, the third arm 323 and the fourth arm 324 of the second radiator 32 may respectively have a bend such that the ends opened of the third arm 323 and the fourth arm 324 may lie on a same extended line. In such a structure, there are a gap D3 between the end opened of the first arm 311 and the end opened of the third arm 323, and a gap E3 between the end opened of the second arm 323 and the end opened of the fourth arm 324. The gaps D3 and E3 may be adjustable to adjust the matching impedance of the dipole antenna 30. As a result, an antenna designer may adjust multiple parameters, such as the area of the closed loop area A3 and the gap B3, C3, D3 and E3, to increase a design flexibility of the dipole antenna 30.

Figure 5:
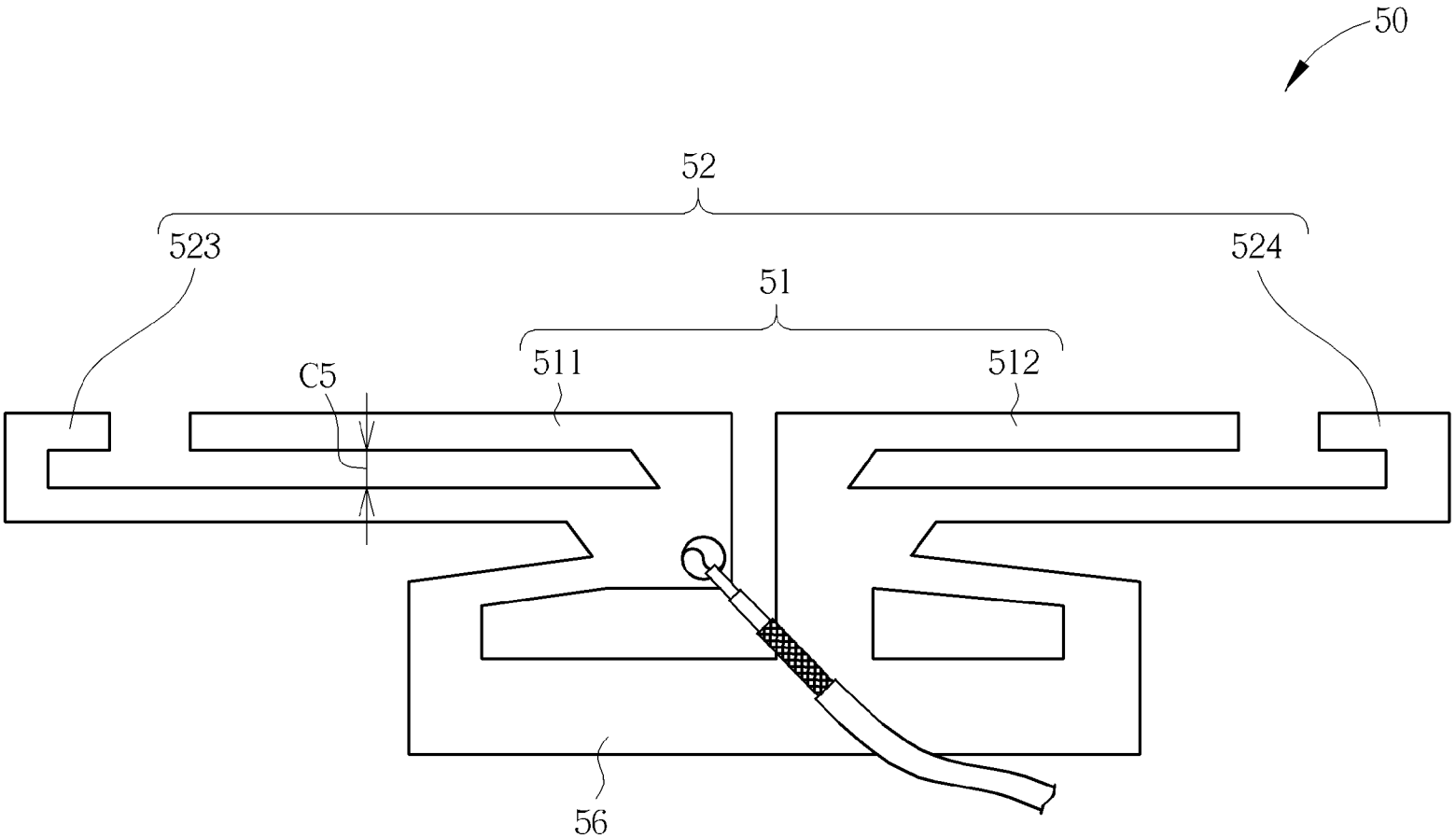
FIG. 5 is a schematic diagram of a dipole antenna according to another embodiment of the present invention.

Please refer to FIG. 5, which is a schematic diagram of a dipole antenna 50 according to an embodiment of the present invention. Comparing the dipole antenna 50 with the dipole antenna 30, areas and lengths of a first arm 511 and a second arm 512 of a first radiator 51 are equal such that the first arm 511 and the second arm 512 are symmetric, while the first arm 311 has a greater area than the second arm 312 such that the first arm 311 is asymmetric to the second arm 312. A gap C5 of the dipole antenna 50 is less or narrower than the gap C3 of the dipole antenna 30, which may increase an effective capacitance between the first arm 511 and a third arm 523, and increase an effective capacitance between the second arm 512 and a fourth arm 524.

Figure 6:
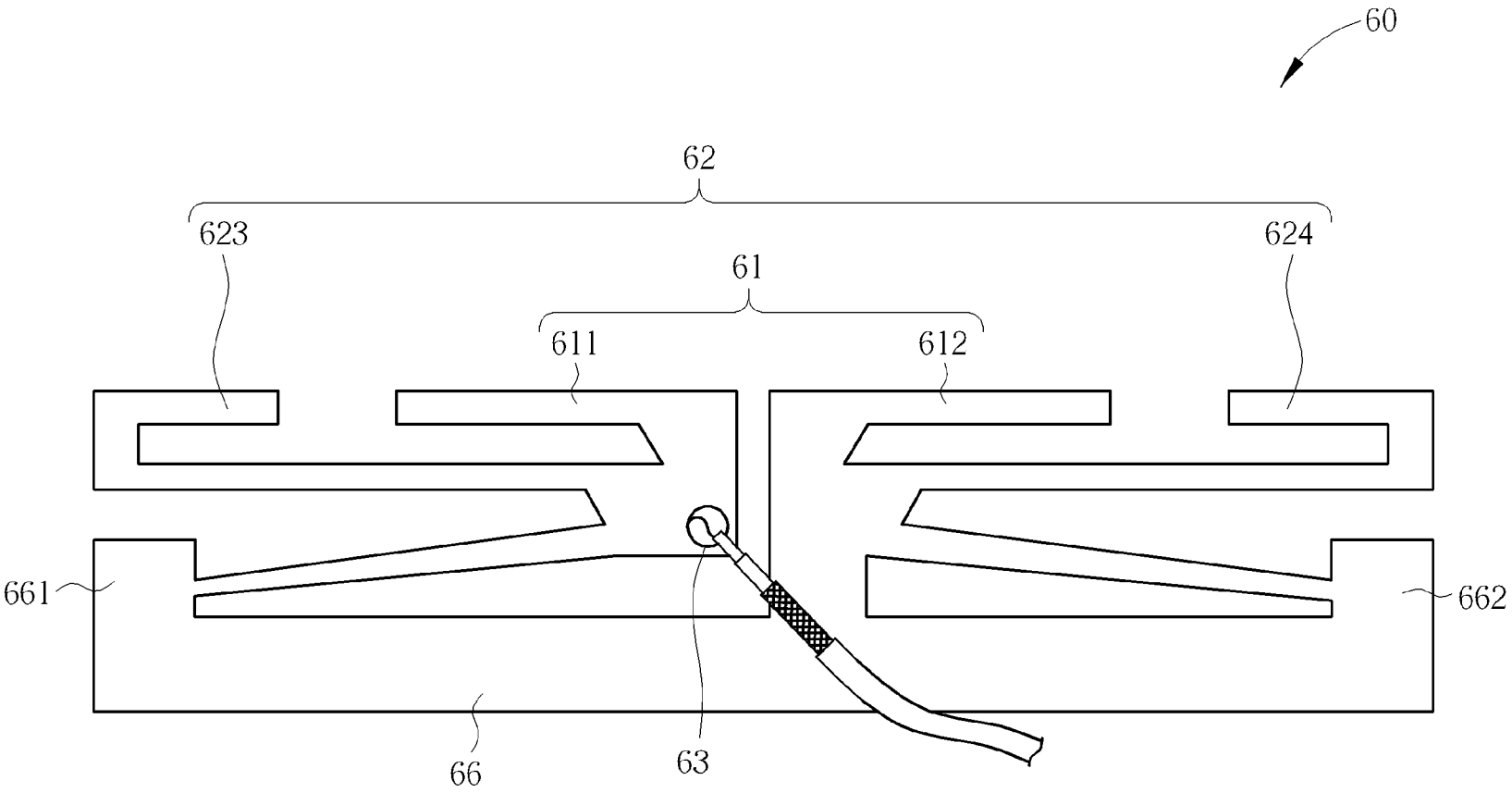
FIG. 6 is a schematic diagram of a dipole antenna according to another embodiment of the present invention.

Please refer to FIG. 6, which is a schematic diagram of a dipole antenna 60 according to an embodiment of the present invention. Comparing the dipole antenna 60 with the dipole antennas 30 and 50, two ends of a ground unit 66 are respectively electrically connected to a third grounded arm 661 and a fourth grounded arm 662. The third grounded arm 661 and the fourth grounded arm 662 are both perpendicular to the ground unit 66, such that the ground unit 66 has a U shape. In the dipole antenna 30, a flat coverage of the first radiator 31 and the second radiator 32 is relatively greater than a flat coverage of the ground unit 36. In comparison, in the dipole antenna 60, a flat coverage of a first radiator 61 and a second radiator 62 is relatively less than a flat coverage of the ground unit 66. Thus, most of a return current of the dipole antenna 60 may flow on the ground unit 66, such that the dipole antenna 60 may reach a better stability and an immunity against the noise. Besides, a length of a current route of the first radiator 61 is relatively less than a length of a current route of a second radiator 62. Specifically, part of the RF signal may flow the shorter current route that from a feed-in terminal 63, the first arm 611 and the second arm 612 to the ground unit 66. On the other hand, part of the RF signal may flow the longer route that is from the feed-in terminal 63, a third arm 623 and a fourth arm 624 and return to the ground unit 66. Thus, the first radiator 61 may be used for radiating the RF signal in the high frequency band, while the second radiator 62 may be used for radiating the RF signal in the low frequency band.

Figure 7:
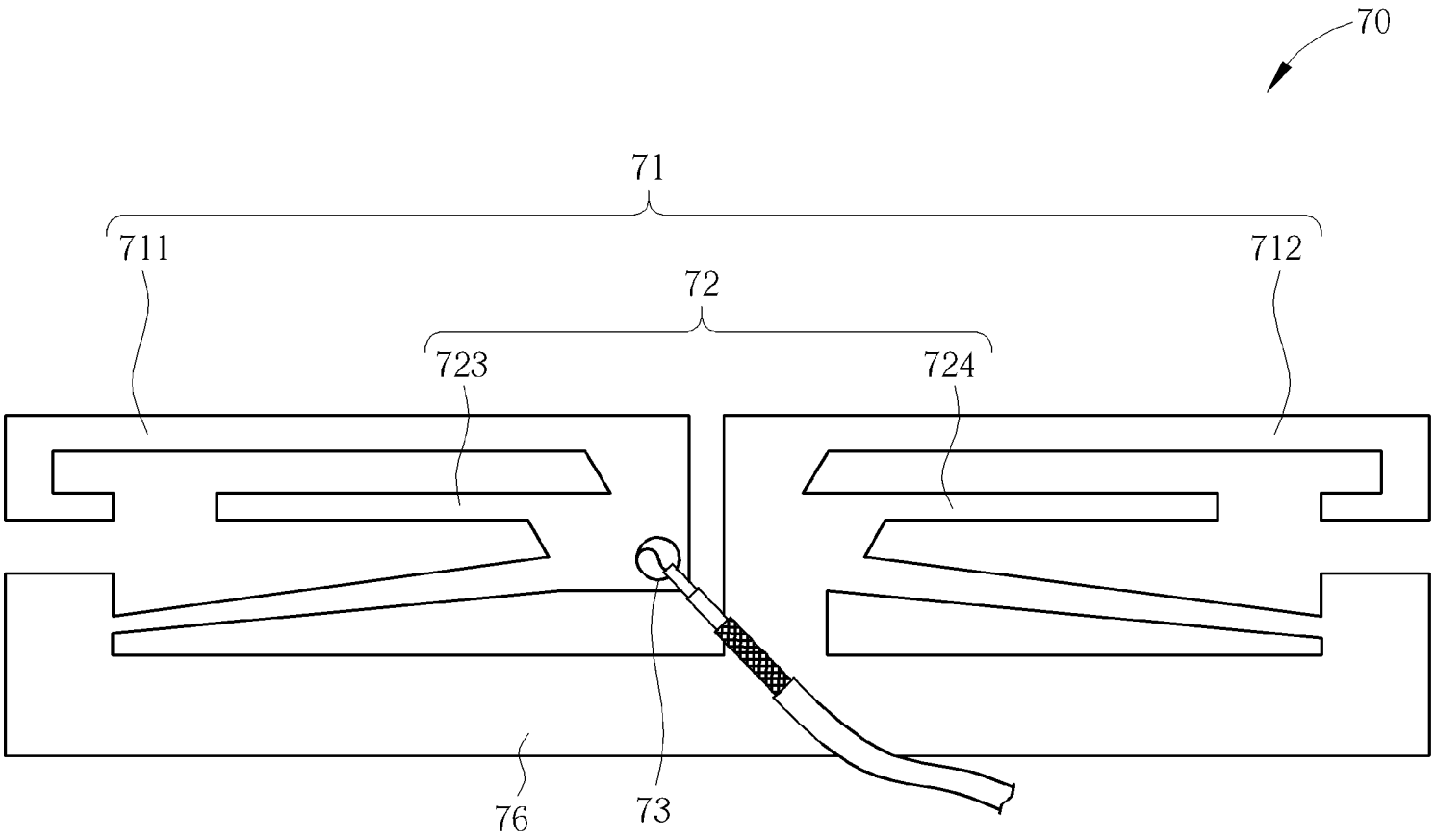
FIG. 7 is a schematic diagram of a dipole antenna according to another embodiment of the present invention.

Please refer to FIG. 7, which is a schematic diagram of a dipole antenna 70 according to an embodiment of the present invention. A difference between the dipole antenna 70 and the dipole antenna 60 is that a first radiator 71 of the dipole antenna 70 is used for radiating the RF signal in a low frequency band, and a second radiator 72 is used for radiating the RF signal in a high frequency band. Specifically, part of the RF signal may flow a longer route that is from a feed-in terminal 73, a first arm 711 and a second arm 712 and return to a ground unit 76. On the other hand, part of the RF signal may flow a longer route that is from the feed-in terminal 73, a third arm 723 and a fourth arm 724 and return to the ground unit 76 . Therefore, the first radiator 71 may be used for radiating the RF signal in the low frequency band, and the second radiator 72 may be used for radiating the RF signal in the high frequency band. In short, relative locations of the radiators respectively used for radiating the RF signal in the low or high frequency band may be switched according practical requirements.

To sum up, the gain of the dipole antenna is theoretically higher than the gain of the monopole antenna and also higher than the gain of the PIFA, however, the co-axial cable 14 may unbalance the feed-in impedance of the dipole antenna. Therefore, the dipole antennas 30, 50, 60 and 70 of the present invention include the balun to convert the feed-in impedance of the antenna 30 from unbalanced into balanced, which may reduce the electromagnetic interference effect caused by the return current and improve the stability of the dipole antennas 30, 50, 60 and 70.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dipole antenna, comprising:

a feed-in terminal for feeding in an radio-frequency signal;

a balun electrically connected to the feed-in terminal for driving out a return current of the dipole antenna to balance a feed-in impedance of the dipole antenna;

a first radiator electrically connected to the feed-in terminal and the balun for radiating the radio-frequency signal in a first frequency band, the first radiator comprising:

a first arm having one end electrically connected to the feed-in terminal and the balun, the first arm having another end opened; and a second arm having one end electrically connected to the balun, the second arm having another end opened; and a second radiator electrically connected to the first radiator, the feed-in terminal and the balun for radiating the radio-frequency signal in a second frequency band, the second radiator comprising:

a third arm having one end electrically connected to the feed-in terminal, the first arm and the balun, the third arm having another end opened; and a fourth arm electrically connected to the balun and the second arm, the fourth arm having another end opened;

wherein the balun comprises:

a ground unit for providing ground;

a first grounded arm having one end electrically connected to the first arm of the first radiator, the third arm of the second radiator and the feed-in terminal, the first grounded arm having another end electrically connected to the ground unit; and a second grounded arm having one end electrically connected to the second arm of the first radiator, the fourth arm of the second radiator, the second grounded arm having another end electrically connected to the ground unit.

2. The dipole antenna of claim 1, wherein the second grounded arm and the ground unit of the balun form a closed loop area, a size of the closed loop area is adjustable to adjust a matching impedance of the dipole antenna.

3. The dipole antenna of claim 1, wherein the balun further comprises a third grounded arm and a fourth grounded arm, the third grounded arm and the fourth grounded arm are perpendicular to the ground unit and respectively electrically connected to two ends of the ground unit such that the ground unit has a U shape.

4. The dipole antenna of claim 1, wherein a first gap between the first arm of the first radiator and the second arm of the first radiator induces a coupling effect to adjust a match impedance of the dipole antenna.

5. The dipole antenna of claim 1, wherein a second gap between the first arm and the third arm and between the second arm and the fourth arm is adjustable to adjust a match impedance of the dipole antenna.

6. The dipole antenna of claim 1, wherein the first and second arms of the first radiator respectively have a bend such that the ends opened of the first and second arms lie on a same extended line, or the third and fourth arms of the second radiator respectively have a bend such that the ends opened of the third and fourth arms lie on a same extended line.

7. The dipole antenna of claim 6, wherein a third gap between the end opened of the first arm and the end opened of the third arm is adjustable to adjust a match impedance of the dipole antenna, and a fourth gap between the end opened of the second arm and the end opened of the fourth arm is adjustable to adjust the match impedance of the dipole antenna.

8. A radio-frequency device, comprising:

a radio-frequency signal process unit for generating a radio-frequency signal; and a dipole antenna comprising:

a feed-in terminal for feeding in the radio-frequency signal;

a balun electrically connected to the feed-in terminal for driving out a return current of the dipole antenna to balance a feed-in impedance of the dipole antenna;

a first radiator electrically connected to the feed-in terminal and the balun for radiating the radio-frequency signal in a first frequency band, the first radiator comprising:

a first arm having one end electrically connected to the feed-in terminal and the balun, the first arm having another end opened; and a second arm having one end electrically connected to the balun, the second arm having another end opened; and a second radiator electrically connected to the first radiator, the feed-in terminal and the balun for radiating the radio-frequency signal in a second frequency band, the second radiator comprising:

a third arm having one end electrically connected to the feed-in terminal, the first arm and the balun, the third arm having another end opened; and a fourth arm electrically connected to the balun and the second arm, the fourth arm having another end opened;

wherein the balun comprises:

a ground unit for providing ground;

a first grounded arm having one end electrically connected to the first arm of the first radiator, the third arm of the second radiator and the feed-in terminal, the first grounded arm having another end electrically connected to the ground unit; and a second grounded arm having one end electrically connected to the second arm of the first radiator, the fourth arm of the second radiator, the second grounded arm having another end electrically connected to the ground unit.

9. The radio-frequency device of claim 8, wherein the second grounded arm and the ground unit of the balun form a closed loop area, a size of the closed loop area is adjustable to adjust a matching impedance of the dipole antenna.

10. The radio-frequency device of claim 8, wherein the balun further comprises a third grounded arm and a fourth grounded arm, the third grounded arm and the fourth grounded arm are perpendicular to the ground unit and respectively electrically connected to two ends of the ground unit such that the ground unit has a U shape.

11. The radio-frequency device of claim 8, wherein a first gap between the first arm of the first radiator and the second arm of the first radiator induces a coupling effect to adjust a match impedance of the dipole antenna.

12. The radio-frequency device of claim 8, wherein a second gap between the first arm and the third arm and between the second arm and the fourth arm is adjustable to adjust a match impedance of the dipole antenna.

13. The radio-frequency device of claim 8, wherein the first and second arms of the first radiator respectively have a bend such that the ends opened of the first and second arms lie on a same extended line, or the third and fourth arms of the second radiator respectively have a bend such that the ends opened of the third and fourth arms lie on a same extended line.

14. The radio-frequency device of claim 13, wherein a third gap between the end opened of the first arm and the end opened of the third arm is adjustable to adjust a match impedance of the dipole antenna, and a fourth gap between the end opened of the second arm and the end opened of the fourth arm is adjustable to adjust the match impedance of the dipole antenna.

* * * * *